US005456421A

United States Patent [19]

Reed

[11] Patent Number: 5,456,421

[45] Date of Patent: Oct. 10, 1995

[54] TOILET TISSUE DISPENSER

[76] Inventor: Donald J. Reed, 27550 Clark Rd., Wellington, Ohio 44090

[21] Appl. No.: 194,833

[22] Filed: Feb. 14, 1994

[51] Int. Cl.[6] ..... B65H 16/02

[52] U.S. Cl. ..... 242/598.2; 242/594.3

[58] Field of Search ..... 242/594, 594.3, 242/598, 598.2, 598.3, 599; D6/518, 520, 523

[56] References Cited

U.S. PATENT DOCUMENTS

| | | | |
|---|---|---|---|
| D. 267,760 | 2/1983 | Vrignaud . | |
| D. 305,488 | 1/1990 | Korpijaako . | |
| 1,338,057 | 4/1920 | Wasser . | |
| 1,721,200 | 7/1929 | Beardsley . | |
| 1,772,917 | 7/1929 | Sifferman . | |
| 1,889,024 | 11/1932 | Marsh . | |
| 2,146,038 | 2/1939 | West . | |
| 2,805,029 | 9/1957 | Fanning . | |
| 3,157,370 | 11/1964 | Gouatsos et al. . | |
| 3,291,411 | 12/1966 | Krueger et al. | 242/598.2 |
| 3,335,973 | 8/1967 | Genn | 242/598.1 |
| 3,430,877 | 3/1969 | Berlet | 242/598.2 |
| 3,799,467 | 3/1974 | Bauman . | |
| 3,824,953 | 7/1974 | Boone | 206/225 |
| 3,830,198 | 8/1974 | Boone | 206/225 |
| 4,871,123 | 10/1989 | Lee . | |

*Primary Examiner*—John P. Darling
*Attorney, Agent, or Firm*—Sand & Sebolt

[57] ABSTRACT

A toilet tissue dispenser adapted to be mounted on a toilet facility wall for retaining a plurality of paper rolls. The toilet tissue dispenser secures a plurality of paper rolls against theft and includes a body having a mounting plate, and a pair of spaced apart side flanges. A hanger assembly is pivotally mounted between the side flanges and includes a grab bar mounted therebetween. A pair of parallel and spaced apart end support weldments and a center weldment depend from the grab bar. The center weldment is equally spaced between the end support weldments, and is parallel thereto. A spindle extends through axially aligned holes in the end and center weldments to support the plurality of paper rolls. Each end of the spindle includes a spindle lock complimentarily sized to fit within a locking recess formed in the respective end flanges. A key rotates the spindle lock into or out of engagement with the locking recess. When the spindle lock is moved out of engagement with the recess, the hanger assembly may be moved to an open position where the spindle may be moved within the holes to permit the loading of the paper roll. In a second embodiment of the invention, safety grab bar extensions extend outwardly from the side flanges, in axial alignment with the grab bar.

20 Claims, 4 Drawing Sheets

TOILET TISSUE DISPENSER

BACKGROUND OF THE INVENTION

1. Technical Field

The invention relates generally to an improved paper roll dispensing device. More particularly, the invention relates to a paper roll holding and dispensing device for toilet tissue. Specifically, the invention relates to a toilet tissue holding and dispensing device that is vandal resistant and substantially reduces the risk of theft of the toilet tissue roll.

2. Background Information

It is customary in commercial buildings to provide toilet issue dispensers for multiple rolls in the public toilet facilities. Multiple roll dispensers are utilized as the increased traffic in these facilities increases the use of toilet tissue. Supplying multiple roll dispensers thus reduces the number of times staff must visit the toilet facility to restock toilet tissue thereby reducing the cost associated with building maintenance and operation. One problem associated with public toilet facilities is the amount of seclusion inherent therein. This seclusion increases the possibility of theft of the toilet tissue.

Heretofore, a significant number of multiple dispensers have been developed that are presumably sufficient for the purpose for which they were intended. However in many designs, the tissue roll is readily accessible to persons within the public facility thereby increasing the possibility of theft of the roll. In large buildings, or public areas, such as highway rest areas, a significant amount of money is expended on toilet tissue, which cost is further increased by theft. As such, the need exists for a toilet tissue dispenser which secures the roll in such a manner that it may be easily utilized, while simultaneously resisting the theft of the roll.

The seclusion available in public toilet facilities, in combination with the general public access, also creates an ideal forum for vandalism. All public facilities, and especially facilities in roadside rest areas, schools, and government buildings are inherently susceptible to vandalism which increases operating costs, increases safety concerns, and also detracts from the aesthetic appearance of the building. A number of toilet tissue dispensers are also known in the art, but they can be complicated, and easily vandalized. Specifically, there is a need for a toilet tissue dispenser which cannot be removed from the wall without substantially destroying the wall, and also a dispenser which itself is not susceptible to vandalism.

Further, as society becomes increasingly concerned with handicap sensitive buildings, and in fact many local codes include handicap sensitive regulations, the need for safe and economical lift bars in public facilities continues to grow. Prior art designs include a toilet tissue dispenser positioned below a separate lift bar, usually manufactured of stainless steel. Inasmuch as the lift bar must be located between 33 and 36 inches from the floor as set forth in the American Disabilities Act, which is considered the optimum location for access, the paper dispenser must be located other than at the optimum location for access. Moreover, more material is required to create both a lift bar and a toilet tissue dispenser thereby increasing the purchase price as well as the cost of installation.

Thus, the need exists for a toilet tissue dispenser which secures the toilet tissue roll within the dispenser against theft and which is resistant to vandalism. Moreover, a need exists for a toilet tissue dispenser which is integrally formed with a lift bar, and which may be mounted adjacent lift bar extensions which extend outwardly from the toilet tissue dispenser to increase the effective overall length of the lift bar.

SUMMARY OF THE INVENTION

Objectives of the invention include providing a toilet tissue dispenser which is resistant to vandalism.

A further objective includes providing such a toilet tissue dispenser which retains multiple toilet tissue rolls.

Another objective of the invention is to provide a toilet tissue dispenser which secures the multiple toilet tissue rolls against theft.

Yet another objective is to provide such a toilet tissue dispenser which has a lift bar integrally formed therewith.

A still further objective is to provide a toilet tissue dispenser which may be mounted with lift bar extensions extending outwardly therefrom.

A further objective is to provide such a toilet tissue dispenser which may be easily loaded with toilet tissue when installed in a public facility.

Yet another objective is to provide such a toilet tissue dispenser which may only be loaded and unloaded with the use of a specialized key.

These and other objectives and advantages of the invention are obtained by the improved toilet tissue dispenser, the general nature of which may be stated as including a body having a mounting plate and a pair of spaced apart side flanges; a hanger assembly depending from said pair of spaced apart side flanges; pivot means for pivotally attaching said hanger assembly to said body and between said pair of side flanges; spindle means adapted for supporting the paper roll; and lock means for securing the spindle between said flanges.

BRIEF DESCRIPTION OF THE DRAWINGS

The preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
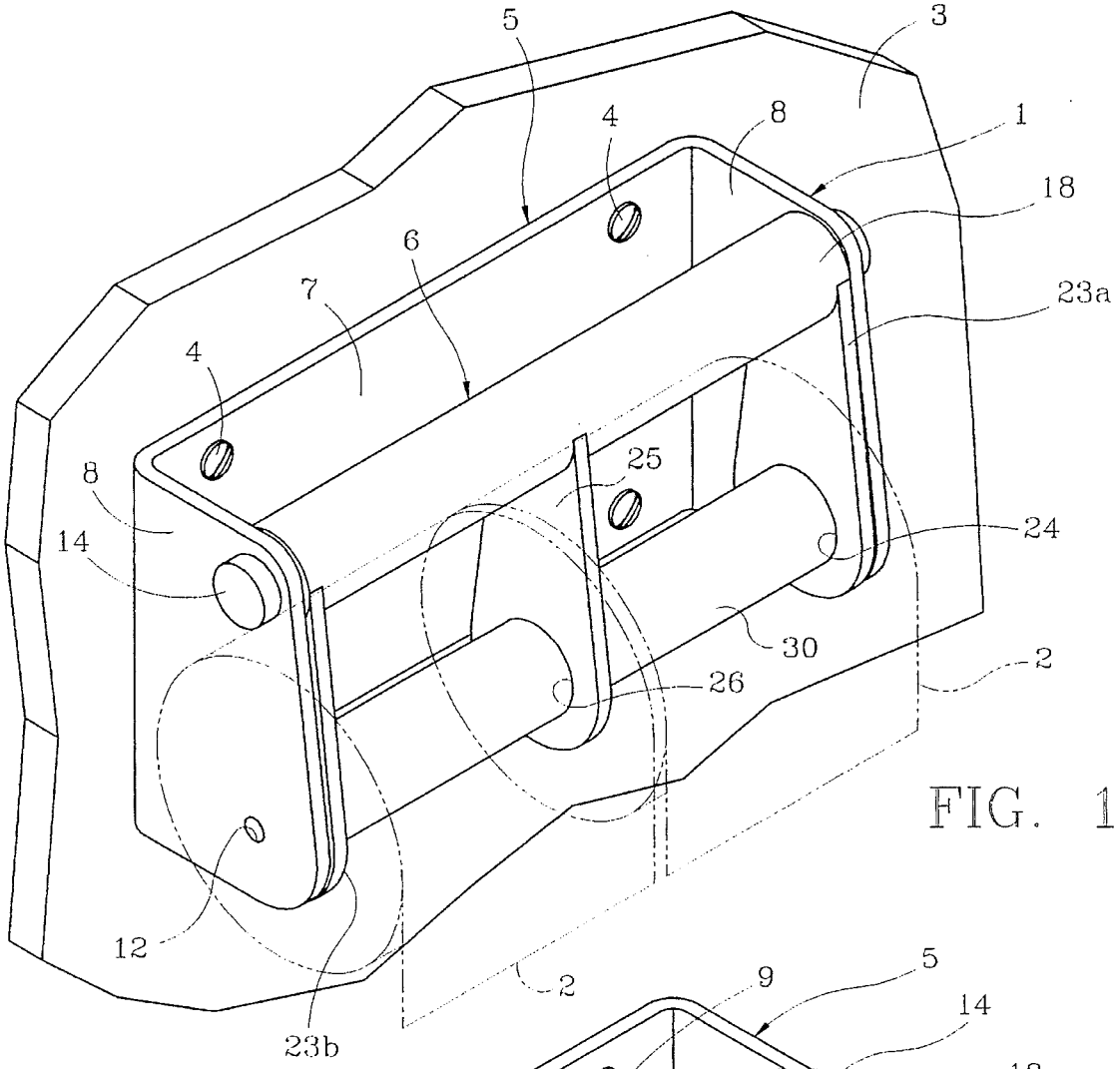
FIG. 1 is a perspective view of the toilet tissue dispenser of the present invention shown in the closed position and mounted on a toilet facility wall.

The improved toilet tissue dispenser of the invention is indicated generally at 1, and is adapted to hold a plurality of toilet tissue rolls, two of which are illustrated in FIG. 1 in dot-dash lines, and are indicated generally at 2. Moreover, toilet tissue dispenser 1 is adapted to be mounted on a toilet facility wall 3. While a variety of mounting methods are acceptable, the preferred embodiment envisions the use of tamper resistant screws 4.

Figure 2:
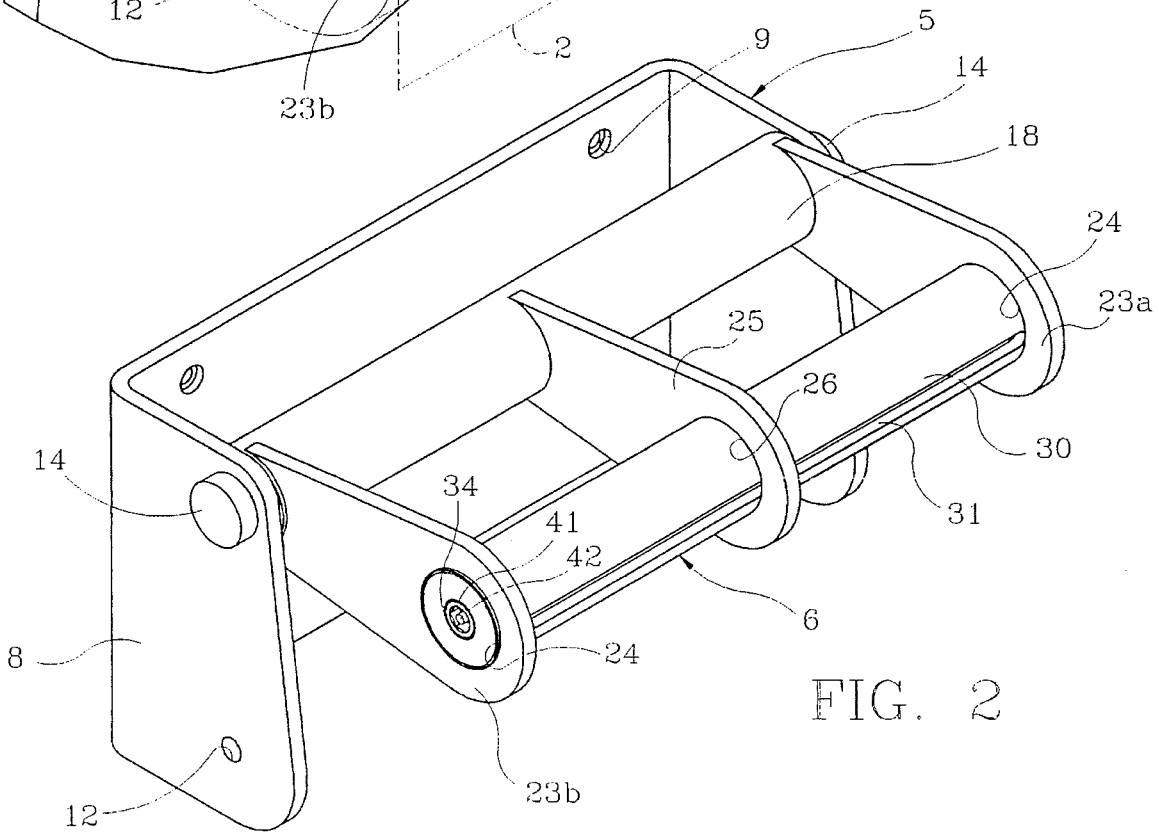
FIG. 2 is a perspective view of the toilet tissue dispenser shown in the open position.

Referring specifically to FIG. 1, toilet tissue dispenser 1 includes a body 5 and a hanger assembly 6. Body 5 includes a mounting plate 7 and a pair of spaced apart parallel side flanges 8 integrally formed with mounting plate 7 and extending substantially perpendicularly outwardly therefrom. A plurality of counterbored mounting holes 9 (FIG. 2) for accepting tamper-proof screws 4 extend through mounting plate 7.

A locking recess 11 (FIG. 5) extends partially through each side flange 8, and an access hole 12 extends through each side flange 8 and is coaxial with and joins locking recess 11. Each side flange 8 also includes a pivot hole 13 (FIG. 6) for accepting a pivot pin 14, the purpose for which will be described in detail hereinbelow.

Figure 6:
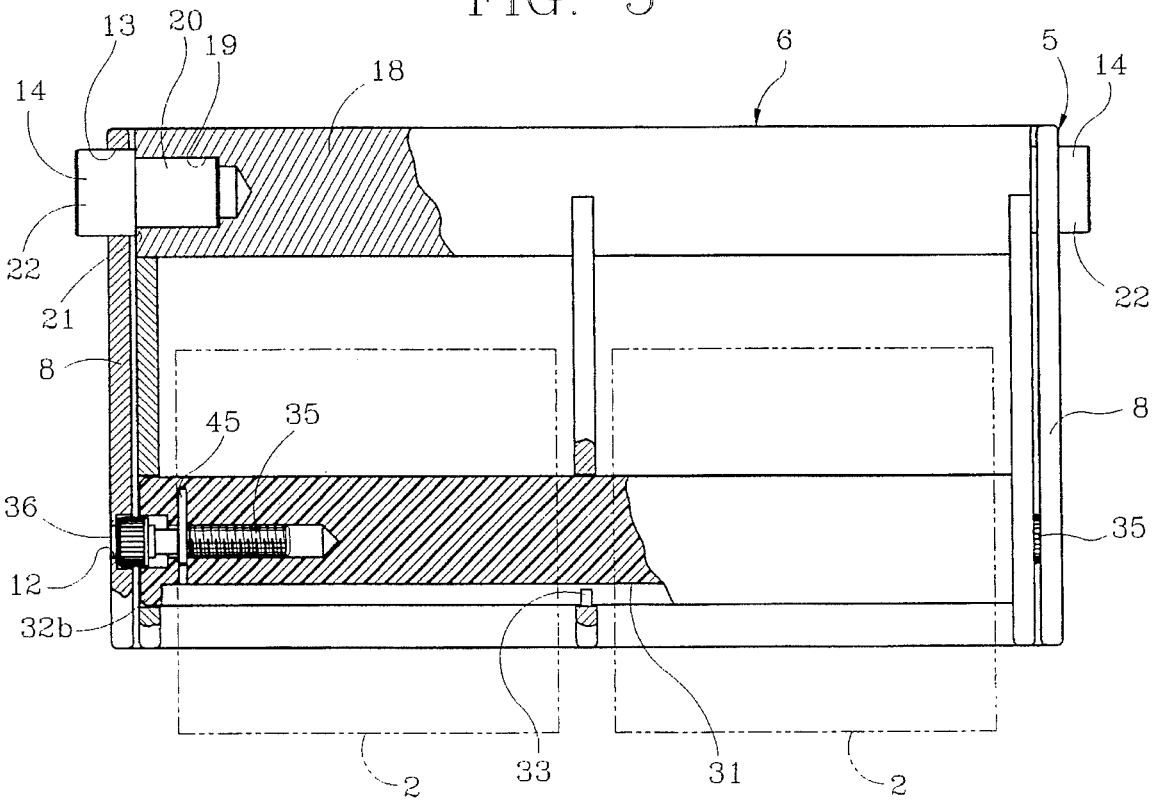
FIG. 6 is an elevational view of the toilet tissue dispenser of FIG. 1 in the locked position with portions cut-away and in section.

In accordance with one of the main features of the invention, hanger assembly 6 includes a grab bar 18 which has a hole 19 formed in each end thereof (FIG. 6). Each hole 19 is complementary sized to accept a neck portion 20 of a corresponding pivot pin 14. Neck portion 20 of each pivot pin 14 ends at a shoulder 21 to form a mounting boss 22 (FIG. 6). Thus, neck portion 20 of each pivot pin 14 extends through a corresponding pivot hole 13 formed in flange 8 and into one hole 19. Thus shoulders 21 of pivot pins 14 contact the ends of grab bar 18. In this manner, grab bar 18 is rotatably mounted on body 5, and is thus movable between the closed position shown in FIG. 1, and the open position shown in FIG. 2. It should be apparent to one of ordinary skill in the art that pivot pins 14 may be of a single diameter without departing from the spirit of the present invention.

A pair of parallel and spaced apart support weldments 23*a* and 23*b* (FIG. 4), collectively referred to as support weldments 23, depend from respective ends of grab bar 18, with each weldment having a hole 24 extending therethrough. A central weldment 25 depends from the center of grab bar 18, and is equally spaced between, and is parallel to, support weldments 23. Center weldment 25 includes a hole 26 axially aligned with holes 24. The distance between center weldment 25 and each support weldment 23 is sufficient to accept a toilet tissue roll 2. Moreover, holes 24 and 26 are axially aligned and are spaced on weldments 23 and 25 respectively, a distance from grab bar 18 greater than the radius of toilet tissue roll 2.

Figure 4:
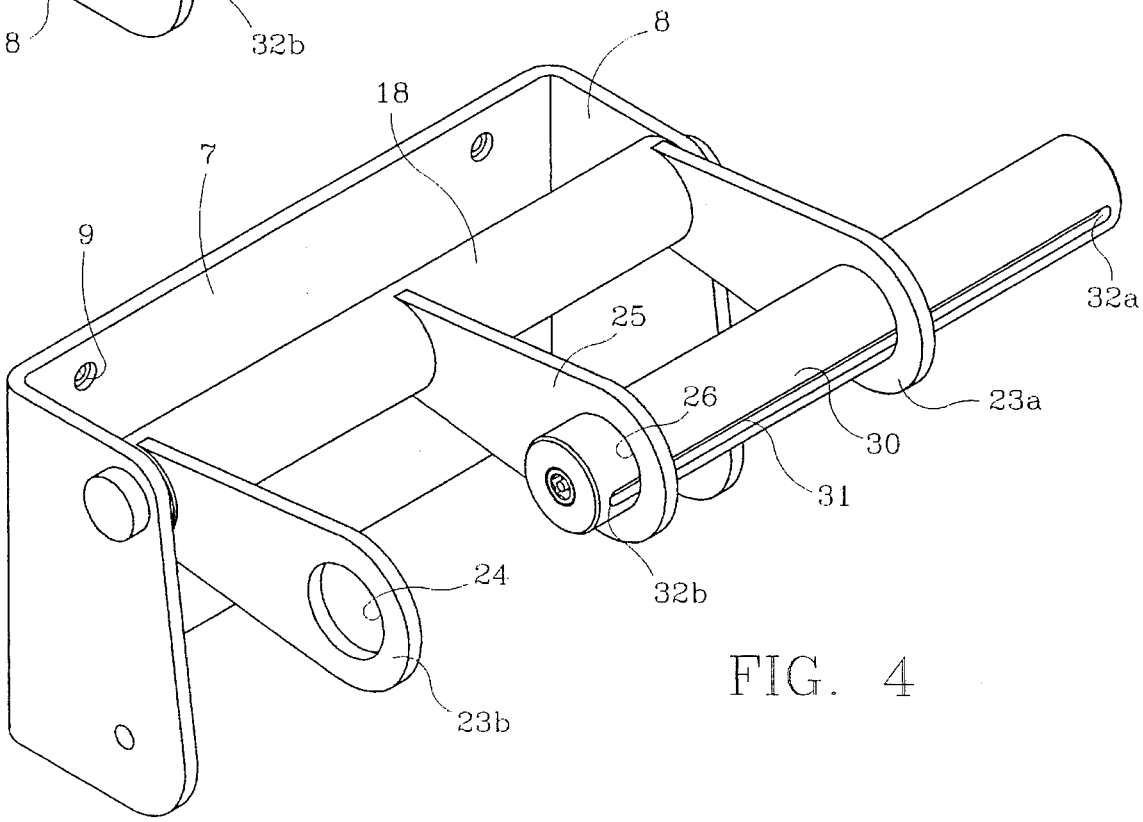
FIG. 4 is a perspective view of the toilet tissue dispenser of FIG. 2 with the spindle moved to a second open position.
Figure 5:
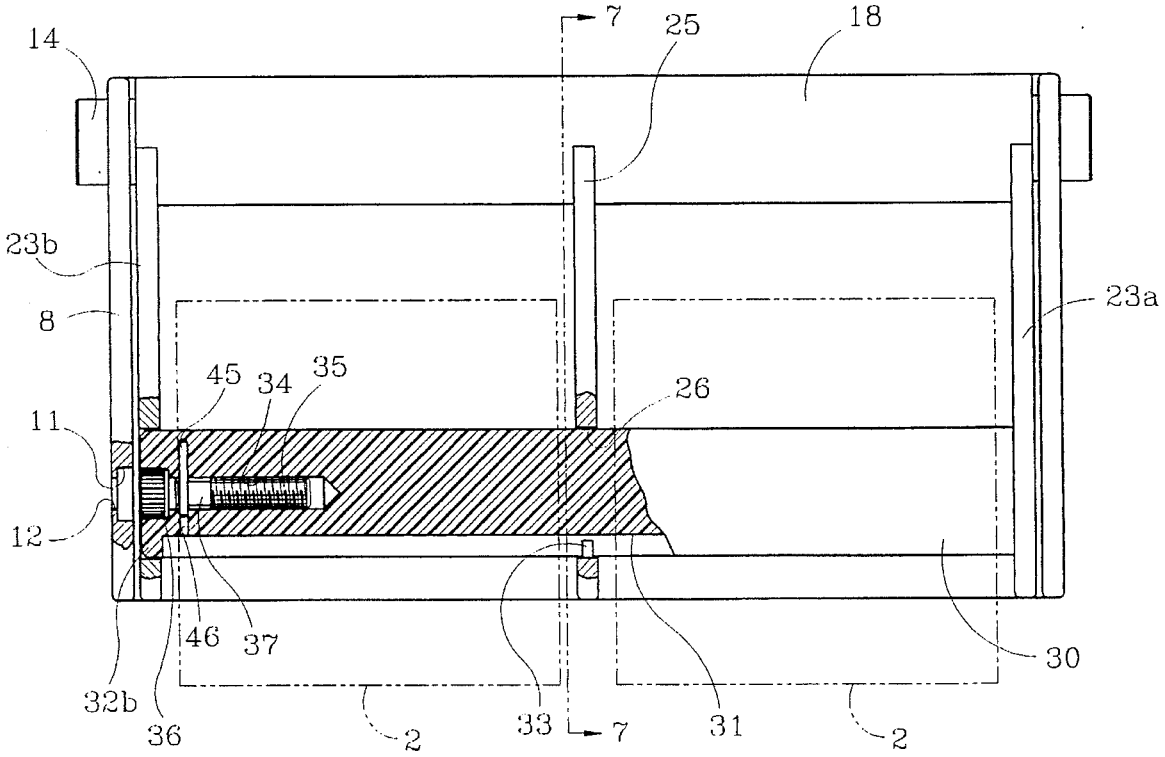
FIG. 5 is an elevational view of the toilet tissue dispenser of FIG. 1 in the unlocked position with portions cut-away and in section.
Figure 7:
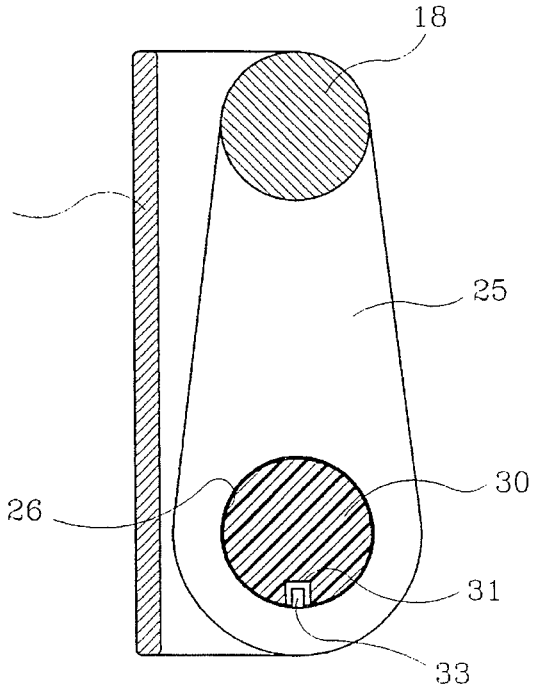
FIG. 7 is a sectional view of the toilet tissue dispenser taken along line 7—7, FIG. 5.

A spindle 30 having a diameter smaller than the interior diameter of paper roll 2 is mounted within holes 24 and 26. A double blind guideway 31 is milled into spindle 30 such that guideway 31 does not extend to the ends of spindle 30. The unmilled portion of spindle 30 acts as a guideway stop 32*a* and 32*b* (FIGS. 3–4) at each end of guideway 31. As best seen in FIGS. 5–7, a guide pin 33 is fixedly mounted on center weldment 25 and projects into hole 26 and extends into guideway 31. The operative engagement of guideway 31, and guide pin 33 prevents the rotation of spindle 30 within holes 24 and 26. Moreover, the operative engagement between guide pin 33 and guideway stops 32 prevent the spindle from being removed from hanger assembly 6. It is also noted that the outside diameter of spindle 30 is slightly smaller than the inside diameter of holes 24 and 26 to provide free sliding motion therebetween. Spindle 30 is also just slightly smaller than the inside diameter of the outer diameter of paper roll 2 such that spindle 30 frictionally engages paper roll 2 to control the rotation of paper roll 2.

In accordance with another feature of the invention, each end of spindle 30 includes a threaded hole 34 for threadably engaging a spindle lock 35 as best seen in FIG. 5. Spindle locks 35 are threaded tamper-proof bolts, each with a head 36, and a necked portion 37 adjacent head 36. Head 36 is sized to fit within a corresponding locking recess 11. A pin 45 is positioned within a keyway 46 adjacent necked portion 37 to limit the axial travel of spindle lock 35 so as to prevent the removal of spindle lock 35.

Figure 9:
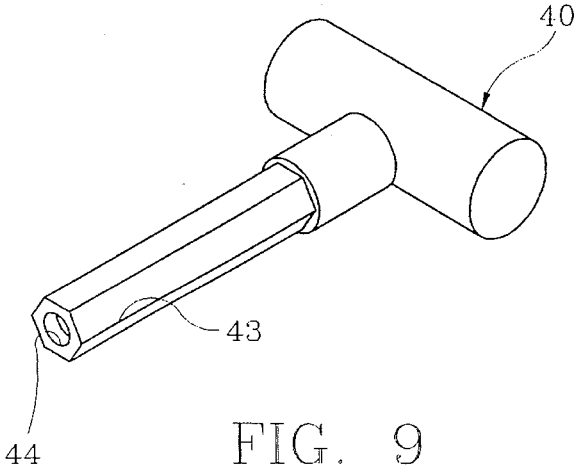
FIG. 9 is a perspective view of the key of the present invention.

A key 40 shown specifically in FIG. 9, is sized to extend through access hole 12, and into head 36 of spindle lock 35. While any other tamper resistant bolt may be utilized to lock spindle 30 in the closed position; in the preferred embodiment, head 36 of spindle lock 35 includes a hexagonal bolt recess 41 (FIG. 2) with a pin 42 extending from the center thereof. Similarly, key 40 (FIG. 9) includes a hexagonal circumferential surface 43 sized to fit within hexagonal bolt recess 41, and a center recess 44 sized to accept center pin 42.

In operation, when key 40 is inserted through access hole 12, and into hexagonal bolt recess 41 of spindle lock 35, the key will complementary engage head 36 such that the key may be turned clockwise to move spindle lock 35 out of engagement with locking recess 11. Conversely, key 40 may be rotated counter-clockwise to move head 36 of spindle lock 35 axially out of spindle 30 and into engagement with locking recess 11.

Once key 40 has been inserted through each access hole 12, and each spindle lock 35 has been rotated in the clockwise direction such that heads 36 are removed from engagement with respective locking recesses 11 as shown specifically in FIG. 5, the hanger assembly 6 is unlocked from body 5. Grab bar 18 then is rotated on pivot pins 14 until hanger assembly 6 is in the open position shown particularly in FIG. 2. Spindle 30 may then be moved within holes 24 and 26 until guide pin 33 contacts guideway stop 32*a* and the empty roll may be removed, and a fresh toilet tissue roll inserted between center weldment 25 and support weldment 23*a*. Thereafter, the spindle may be moved through the opening in toilet tissue roll 2, until guide pin 33 contacts guideway stop 32b. A second toilet tissue roll 2 may be installed between center weldment 25 and support weldment 23*b*. Spindle 30 is then moved back through holes 24 and 26 to its original position, and hanger assembly 6 is moved back to the position shown in FIGS. 1 and 5. Key 40 is then reinserted into access holes 12, and spindle locks 35 are rotated in the counter-clockwise direction until heads 36 of spindle locks 35 engage respective locking recesses 11 as shown in FIG. 6.

Figure 3:
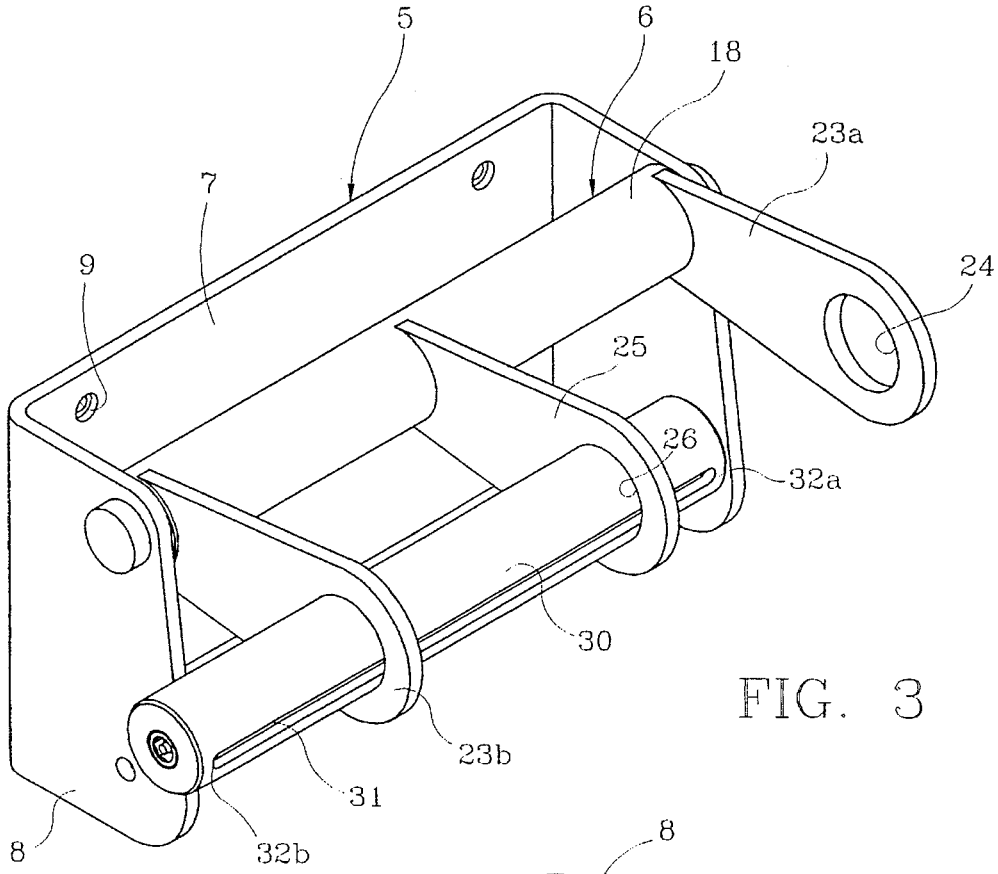
FIG. 3 is a perspective view of the toilet tissue dispenser of FIG. 2 with the spindle moved to a first open position.

As should be apparent to one of ordinary skill in the art, the spindle could be moved to the position shown in FIG. 4 first, and subsequently to the position shown in FIG. 3, with the above description being only one of the methods of operation. Moreover, in the preferred embodiment body 5 and hanger assembly 6 are manufactured of high strength stainless steel to further resist vandalism, and promote sanitation and cleanliness within the toilet facility. However, a variety of materials could be utilized to manufacture the toilet tissue dispenser of the present invention.

Figure 8:
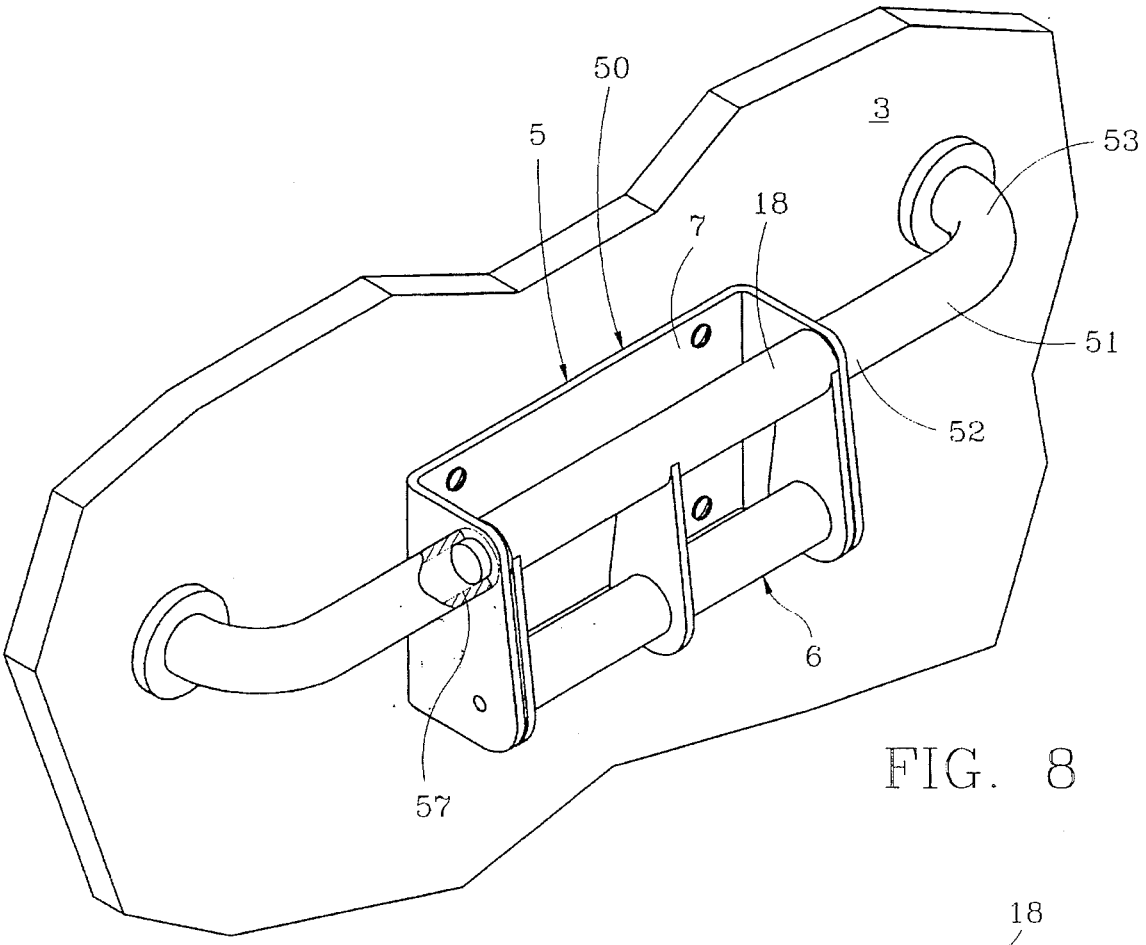
FIG. 8 is a perspective view of the toilet tissue dispenser of a second embodiment of the present invention shown installed on a toilet facility wall with lift bar extensions extending outwardly therefrom.

A second embodiment of the present invention is shown in FIG. 8 and is indicated generally at 50. Toilet tissue dispenser 50 is similar to toilet tissue dispenser 1 described hereinabove, with the exception that grab bar extensions 51 are mounted thereto. Grab bar extensions 51 include a first end 52 in axial alignment with grab bar 18. First end 52 of each grab bar extension 51 includes a mounting recess 57 which accepts mounting boss 22. A second end 53 of grab bar extensions 51 is curved inwardly toward toilet facility wall 3 and is mounted thereto by any convenient attachment means. In this manner, toilet tissue dispenser 50 is mounted integrally with a grab bar on toilet facility wall 3.

In summary, toilet tissue dispenser 1 substantially eliminates the risk of theft of toilet tissue, while retaining multiple rolls to be used in a public toilet facility. Moreover, the toilet tissue dispenser 1 of the present invention is resistant to vandalism, and is simple to load with an appropriate key 40. Further, toilet tissue dispenser 50 offers all of the above advantages, and also provides additional grab bar extensions to create a single integrally mounted structure, with the toilet tissue roll 2 mounted in a more acceptable position on toilet facility wall 3. Further, toilet tissue dispenser 50 reduces cost in mounting time as grab bar 18 acts as both a grab bar for safety reasons, and also permits the multiple roll hanger assembly 6 to be rotated about pivot pins 14.

Accordingly, the improved toilet tissue dispenser is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved toilet tissue dispenser is constructed and used, the characteristics of the construction, and the advantageous, new and useful results obtained; the new and useful structures, devices, elements, arrangements, parts and combinations, are set forth in the appended claims.

I claim:

1. A toilet tissue dispenser comprising:

a body having a mounting plate adapted to be mounted to a wall having a vertical plane and a pair of spaced apart side flanges;

a hanger assembly supported from said pair of spaced apart side flanges;

pivot means for pivotally attaching said hanger assembly to said body and between said pair of side flanges;

a spindle adapted for supporting the paper roll;

lock means for securing the spindle between said flanges; and a grab bar attached to the body for supporting the weight of a user; and positioned on the body intermediate the vertical plane of the wall, and the user.

2. The toilet tissue dispenser defined in claim 1 in which the pivot means includes a pair of pivot pins extending through the side flanges and into the hanger assembly.

3. The toilet tissue dispenser defined in claim 1 in which the grab bar extends between the side flanges of the body and is rotatably mounted on the pivot means.

4. A toilet tissue dispenser comprising:

a body having a mounting plate and a pair of spaced apart side flanges;

a hanger assembly supported from said pair of spaced apart side flanges which include at least two spaced apart support weldments adapted to receive a paper roll therebetween whereby each support weldment is formed with a weldment hole;

pivot means for pivotally attaching said hanger assembly to said body and between said pair of side flanges whereby the pivot means includes a pair of pivot pins extending through the side of the flanges and into the hanger assembly;

a spindle adapted for supporting the paper roll which spindle is slidably mounted in said weldment holes; and lock means for securing the spindle between said flanges.

5. The toilet tissue dispenser defined in claim 4 in which the hanger assembly further comprises guide means for guiding the spindle in the weldment holes.

6. The toilet tissue dispenser defined in claim 4 in which the spindle includes a guideway; and in which a guide pin is mounted on one of the weldments and extends into the guideway.

7. The toilet tissue dispenser defined in claim 6 in which the guideway extends along only a portion of the spindle; and in which stop means is positioned at each end of said guideway for contacting the guide pin to limit the sliding movement of the spindle.

8. The toilet tissue dispenser defined in claim 4 in which a center weldment extends between the spaced support weldments, and is parallel thereto; in which said center weldment is formed with a hole in axial alignment with the holes extending through the support weldments; and in which the distance between the center weldment and each of the spaced support weldments is sufficient to accept a paper roll.

9. The toilet tissue dispenser defined in claim 4 in which the spindle has a pair of ends each formed with a hole extending therein; in which a spindle lock is mounted in each of said holes; in which each side flange includes a locking recess complimentarily sized to accept a portion of the spindle lock when the hanger assembly is in the closed position; and in which key means are provided for moving the spindle lock into and out of the lock recess.

10. The toilet tissue dispenser defined in claim 9 in which the hole extending into each of the spindle ends is threaded; in which each spindle lock threadably engages one of the respective holes; in which an access hole extends through each of the side flanges and communicates with a respective locking recess; and in which the key means extends through said access hole and engages the spindle lock for rotatably moving the spindle lock into and out of engagement with the locking recess.

11. The toilet tissue dispenser defined in claim 10 in which the spindle lock includes a neck portion; and in which a pin extends into the spindle adjacent the neck portion to limit the axial travel of the spindle lock.

12. The toilet tissue dispenser defined in claim 11 in which the spindle lock is a bolt having a tamper proof head including a bolt recess and a post extending into said bolt recess; and in which the key means is configured to engage said tamper proof head; the key means including a recess to accept the post, and an exterior surface complimentarily shaped to the bolt recess.

13. A toilet tissue dispenser comprising:

a body having a mounting plate adapted to be mounted to a wall having a vertical plane and a pair of spaced apart side flanges;

a hanger assembly supported from said pair of spaced apart side flanges; said hanger assembly including spindle means adapted for supporting the paper roll and a grab bar extending between the side flanges adapted for supporting a user's weight, and positioned on the body intermediate the vertical plane of the wall, and the user; and pivot means for pivotally attaching said hanger assembly to said body and between said pair of flanges.

14. A toilet tissue dispenser comprising:

a body having a mounting plate and a pair of spaced apart side flanges;

a hanger assembly supported from said pair of spaced apart side flanges;

pivot means for pivotally attaching said hanger assembly to said body and between said pair of side flanges;

a spindle adapted for supporting the paper roll;

lock means for securing the spindle between said flanges;

a grab bar extending between the side flanges of the body;

at least one grab bar extension extending outwardly from the side flange; and mounting means for mounting the grab bar extension to said side flange whereby the grab bar extension is axially aligned with the grab bar.

15. The toilet tissue dispenser defined in claim 14 in which the mounting means includes a mounting boss extending outwardly from the side flange complimentarily sized to fit within a hole formed in the grab bar extension.

16. The toilet tissue dispenser defined in claim 15 in which the hanger assembly includes at least two spaced apart support weldments adapted to receive at least one paper roll therebetween, and in which each support weldment is formed with a hole in which the spindle is slideably mounted; in which a center weldment extends between said support weldments and is parallel thereto; in which said center weldment is formed with a slide hole in axial alignment with the support weldment holes; in which the distance between the center weldment and each of the support weldments is sufficient to accept a paper roll; in which the support weldments and center weldment depend from the grab bar; and in which the grab bar pivots at skid pivot means to move the hanger assembly between an open and closed position.

17. A toilet tissue dispenser comprising:

a body having a mounting plate and a pair of spaced apart side flanges;

a hanger assembly supported from said pair of spaced apart side flanges;

pivot means for pivotally attaching said hanger assembly to said body and between said pair of side flanges;

a spindle adapted for supporting the paper roll;

lock means for securing the spindle between said flanges; and in which the spindle has an outer diameter adapted to frictionally engage a paper roll having an inside diameter slightly larger than the outside diameter of the spindle to control the rotation of the paper roll on the spindle.

18. A toilet tissue dispenser comprising:

a body having a mounting plate and a pair of spaced apart side flanges;

a hanger assembly supported from said pair of spaced apart side flanges; said hanger assembly including spindle means adapted for supporting the paper roll and a grab bar extending between the side flanges;

pivot means for pivotally attaching said hanger assembly to said body and between said pair of flanges, whereby the grab bar is rotatably mounted on and extends between the pivot means; and at least one grab bar extension extending outwardly from the side flange, and mounting means for mounting the grab bar extension to said side flange.

19. The toilet tissue dispenser defined in claim 18 in which the grab bar extension is axially aligned with the grab bar.

20. The toilet tissue dispenser defined in claim 19 in which the hanger assembly includes at least two spaced apart support weldments adapted to receive at least one paper roll therebetween; in which each support weldment is formed with a hole in which the spindle is slideably mounted; in which a center weldment extends between said support weldments and is parallel thereto; in which said center weldment is formed with a slide hole in axial alignment with the holes formed in the support weldments; in which the distance between the center weldment and the respective support weldment is sufficient to accept a paper roll; in which the support weldment and center weldment depend from the grab bar; and in which the grab bar pivots at said pivot means to move the hanger assembly between open and closed positions.

* * * * *